United States Patent [19]

Jürgens

[11] Patent Number: 4,471,845

[45] Date of Patent: Sep. 18, 1984

[54] ROTARY DRILL BIT

[75] Inventor: Rainer Jürgens, Altencelle, Fed. Rep. of Germany

[73] Assignee: Christensen, Inc., Salt Lake City, Utah

[21] Appl. No.: 361,669

[22] Filed: Mar. 25, 1982

[30] Foreign Application Priority Data

Apr. 1, 1981 [DE] Fed. Rep. of Germany ..... 3113109

[51] Int. Cl.[3] ..... E21B 10/56

[52] U.S. Cl. ..... 175/329; 175/410

[58] Field of Search ..... 175/329, 330, 409, 410, 175/382, 383, 384, 398, 401, 402, 412, 413, 415, 418, 327

[56] References Cited

U.S. PATENT DOCUMENTS

| | | | |
|---|---|---|---|
| 883,137 | 3/1908 | Karns | 175/384 |
| 977,955 | 12/1910 | Karns | 175/412 |
| 2,960,312 | 11/1960 | Kandle | 175/398 |
| 3,709,308 | 1/1973 | Rowley et al. | 175/329 |
| 4,246,977 | 1/1981 | Allen | 175/410 |
| 4,350,215 | 9/1982 | Radtke | 175/329 |
| 4,351,401 | 9/1982 | Fielder | 175/329 |

FOREIGN PATENT DOCUMENTS

| | | |
|---|---|---|
| 2817986 | 11/1978 | Fed. Rep. of Germany . |
| 2835660 | 3/1979 | Fed. Rep. of Germany . |

*Primary Examiner*—James A. Leppink
*Assistant Examiner*—Hoang C. Dang
*Attorney, Agent, or Firm*—Rufus M. Franklin

[57] ABSTRACT

Cutting elements, for example of polycrystalline sintered diamond, the cutting faces of which are set differently to the cutting direction, are disposed on a rotary drill bit. One group of cutting elements has its cutting faces substantially perpendicular to the cutting direction (straight set cutting elements) while other groups of cutting elements are at an acute angle to the cutting direction (obliquely set cutting elements).

Because of their greater pressure per unit area, the obliquely set cutting elements penetrate more easily into plastic formations and can tear these up. The straight set cutting elements, which do not develop a great pressure per unit area, but work over a wider range, can better pare off the formation prepared by the obliquely set cutting elements.

13 Claims, 15 Drawing Figures

Fig. 2, 3

ROTARY DRILL BIT

The invention relates to a rotary drill bit for deep-well drilling, and in particular to such drill bits having a head on which are provided radially extending groups of cutting elements.

During the sinking of deep wells in the surface of the earth, such drill bits encounter layers of rock of different hardness and partially plastic formation and are therefore exposed to varying drilling conditions. It has been found that known rotary drill bits with cutting elements, the cutting face of which is set substantially perpendicular to the cutting direction, do not achieve the optimum drilling progress under all drilling conditions. Whereas such drill bits produce satisfactory results in hard sandy layers, in soft plastic rock the cutting faces of the cutting elements tend to stick as a result of accumulation of the eroded rock and then slide over the layer of rock without chip formation. This causes rapid wear of the cutting edges so that the bit becomes blunt for any rock drilling. In order to achieve a chip formation nevertheless, the drill bit would have to be driven carefully with a very great axial feeding power, which would greatly increase the wear and the necessary torque. The tendency towards sticking of the cutting faces would not be eliminated by these means, however.

On the other hand, rotary drill bits which are provided with wedge-shaped cutting elements engaging in the formation are particularly suitable for soft formations. As a result of the geometry of the cutting edges, particularly as a result of cutting faces extending at an acute angle to the cutting direction, a plough effect is achieved which permits a better chip formation of the eroded rock with less axial feeding power and less torque. The relatively small effective area of the cutting elements, however, permits only a slight removal of material.

Apart from these two kinds of rotary drill bit, further rotary drill bits with cutting elements disposed in groups, are known through DE-OS No. 28 17 986, DE-OS No. 28 35 660 and U.S. Pat. Ser. No. 3,709,308, wherein the region of individual groups lying in the centre differs from the radial direction of the remaining regions. This construction is connected with the distribution and guiding of the flushing liquid emerging from openings in the bit and is intended to ensure as uniform a supply as possible of flushing liquid to all cutting elements. Furthermore, it is known through the U.S. Pat. Ser. No. 3,709,308 already mentioned to provide branches of the water paths in the marginal region of bits of large diameter, so that here further component groups with cutting elements which then likewise deviate from the radial direction, can be supplied with flushing liquid.

Since the groups of cutting elements deviating from the radial direction only occupy a component region of the surface of the bit and in addition are only aligned from the point of view of an effective distribution of the flushing liquid, a similar drilling behaviour is to be expected as with rotary drill bits with plane cutting elements standing perpendicular to the direction of rotation.

It is an object of the present invention to provide an improved rotary drill bit so that a greater drilling progress is achieved even when sinking a shaft through soft rock formations.

The present invention is a rotary drill bit comprising a threaded pin for a connection to a drilling string or the like rotary drive, and a head provided with groups of cutting elements, each of which comprises a plane cutting face, which groups extend radially from the marginal region of the head into its central region, and in which at least two groups of cutting elements differ with regard to the setting angle of the cutting faces to the direction of cut such that the cutting faces of straight set cutting elements in one group have a component lying substantially at right angles to the direction of cut while the cutting faces of obliquely set cutting elements in the other group have a component lying at an acute angle to the direction of cut.

During the drilling operation, there is a functional cooperation between the two kinds of cutting element with cutting faces substantially perpendicular to the cutting direction and the cutting faces set at an acute angle to the cutting direction. The cutting elements with cutting faces at an angle to the cutting direction, hereinafter called "obliquely set cutting elements", act on the formation in a narrow region and therefore develop a relatively high pressure per unit area. As a result of this high pressure per unit area, the cutting edges can penetrate into the formation without this giving way under the cutting edges and flanks. The formation is therefore torn up and can be pared off in a broad region by the following cutting elements with a perpendicular component of the cutting face to the cutting direction, hereinafter called "straight set cutting elements". The flowing off of the drillings produced in the course of this is effected through the flushing stream directed towards the marginal region of the bit.

Summing up, therefore, the purpose of the obliquely set cutting elements is to prepare the formation for the paring-off operation, while the straight set cutting elements pare off the formation in a broad region.

The cooperation of the straight set and obliquely set cutting elements is not restricted to a precisely determined setting angle but is afforded over a certain range of angles. Thus for the straight set cutting elements, for example, an angle $\alpha$ to the cutting direction between 80 and 90 degrees still has practically no influence on the cutting width. A smaller angle than 90 degrees can be an advantage for the flowing off of the drillings because these have a directional tendency facing towards the marginal region when rolling on the cutting face. So far as the obliquely set cutting elements are concerned, penetration into the formation is facilitated with a very small angle $\beta$, $\gamma$, $\beta'$, $\gamma'$ between cutting direction and cutting face. On the other hand, the ploughed-up furrow should already be so broad that a considerable portion of the drillings to be pared off by the following cutting elements is cut into. An angle $\beta$, $\beta'$ in the region of about 45 degrees can here be regarded as a compromise.

With particularly plastic formations, a plurality of cutting elements may also be provided in which the angle $\gamma$, $\gamma'$ enclosed between the cutting face and the cutting direction is considerably smaller than 45 degrees and the cutting regions of which lie immediately next to one another. The following straight set cutting elements then impinge on a plurality of furrows. The angles between the cutting face and the cutting direction can also be staggered in size ($\gamma$, $\beta$), so that the formation is torn by the first cutting elements, the furrows formed are widened by the second cutting elements and finally the formation is removed with a cutting action by the following straight set cutting elements. In the interests of an optimum cooperation of the cutting elements, the regions of the obliquely set and straight set cutting elements should overlap.

In principle, the obliquely set cutting elements can be aligned both with heir cutting face facing towards the marginal region of the head and towards the central region. Of these two possibilities, however, only the cutting elements aligned with their cutting face towards the marginal region of the head contribute to an improvement in the flowing off of drillings.

In the case of drill bits with a curved surface, obliquely set cutting elements in the region of conical or cylindrical surface segments of the bit head have an influence on the penetration behaviour of the bit in the formation.

Cutting elements, the cutting faces of which are orientated towards the marginal region of the head, reinforce the penetration of the bit while cutting elements with cutting faces orientated towards the central region of the head counteract the penetration. The behaviour of the bit can be neutralized by cutting elements with cutting faces orientated to both sides.

A bit which penetrates independently into the formation can save drill stems or be an advantage when drilling horizontally. In order to reinforce the cutting work, facilitate the flowing off of drillings and cool the cutting elements, nozzles are disposed on the drill bit. The alignment of these nozzles is coordinated with the setting of the cutting faces of the cutting elements and the nozzles allocated to the straight set cutting elements preferably have a radial directional component while the nozzles allocated to the obliquely set cutting elements have a more tangential directional component.

Embodiments of the present invention will now be described, by way of example, with reference to the accompanying drawings, in which.

Figure 1:
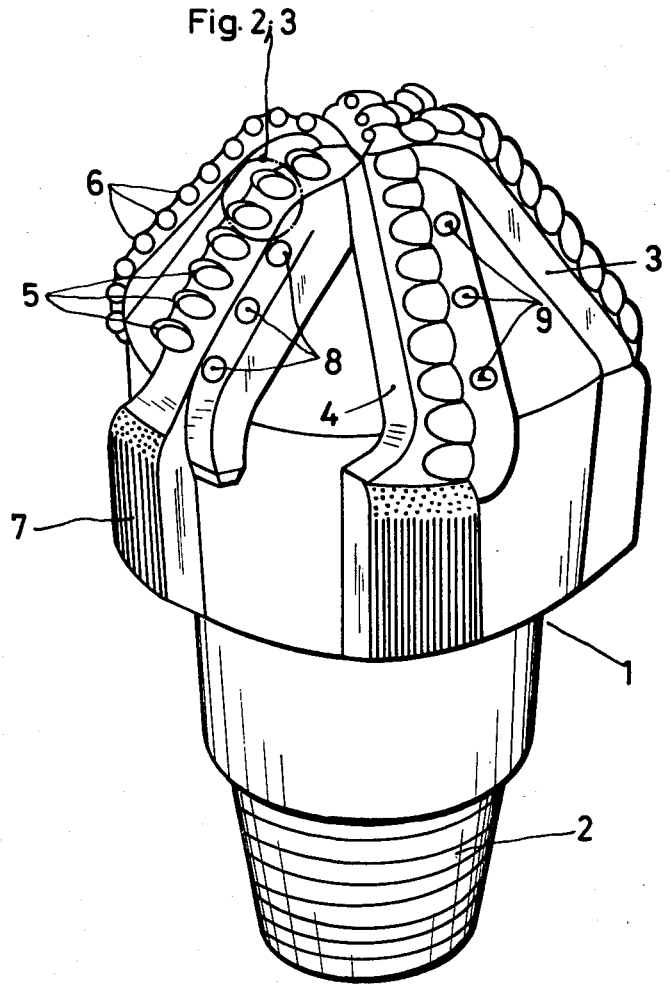
FIG. 1 shows a perspective view of a rotary drill bit which is equipped with obliquely set and straight set cutting elements.

In FIG. 1, a rotary drill bit is illustrated which comprises a connection member 1, a threaded pin 2 for a connection to a drilling string and a head with cutting edges 3, 4. The cutting edges 3 and 4 contain cutting elements 5 and 6 combined projecting in strip-shaped groups and extend in a wall-like raised portion radially from the marginal region of the bit to the center. In the marginal region, this raised portion is continued over a short axial distance and equipped with a hard covering 7 which is impregnated or provided on the surface with abrasion-resistant pieces. Disposed in the valleys between the raised portions, in front of the cutting elements in each case are nozzles 8, 9 which are intended to direct the flushing stream and are in communication with an internal bore at the inlet side. The outlet cones of the nozzles are so dimensioned that all the cutting elements are adequately supplied with flushing. The nozzles 8 are so aligned that they impress a direction tangential to the drill bit towards the cutting elements 5 on the flushing stream. The nozzles 9 on the other hand impress a radial component towards the marginal region of the bit on the flushing stream as a result of their alignment.

The cutting elements 5 and 6 consist of small thin plates of polycrystalline sintered diamond which are circular in plan view and are secured to hard metal supporting members. These in turn are embedded in a matrix binding-agent composition. The cutting faces of the cutting elements 5 are substantially at right angles to the cutting direction, while the cutting faces of the cutting elements 6 are at an angle of about 45 degrees to the cutting direction. The component of the cutting faces associated with these angles extends tangentially to the local surface segment.

Figure 2:
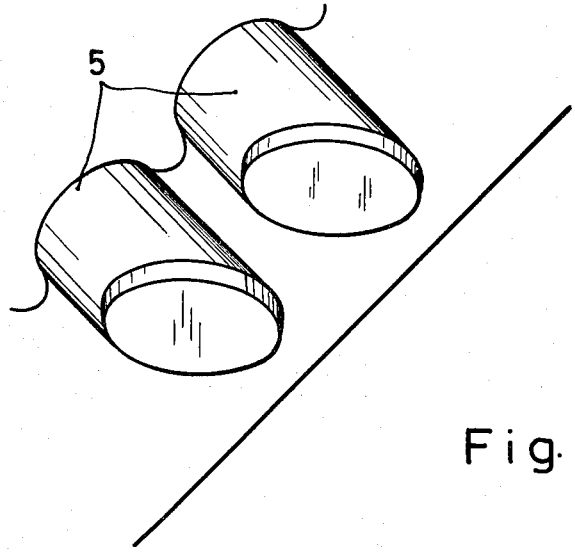
FIG. 2 shows in detail a portion of the bit head with obliquely set cutting faces orientated towards the marginal region.
Figure 3:
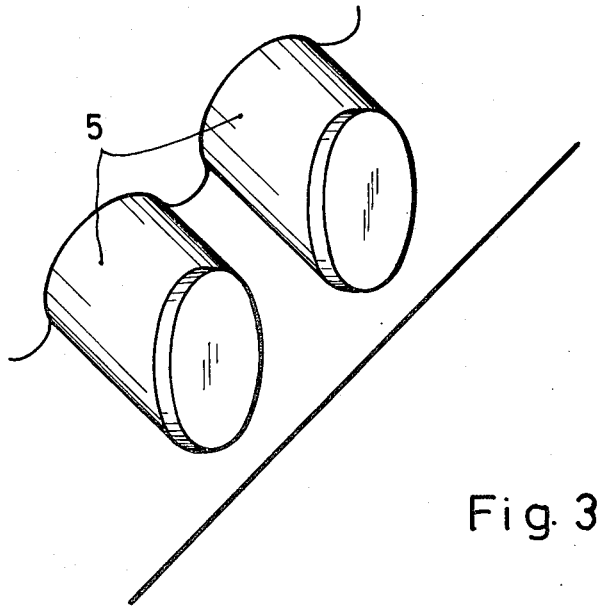
FIG. 3 shows in detail another portion of the bit head with obliquely set cutting faces orientated towards the central region.

FIGS. 2 and 3 show, as detail sketches, the two alternatives in the alignment of the cutting faces of obliquely set cutting elements. In FIG. 2, the cutting faces face towards the marginal region of the head while in FIG. 3 they are orientated towards the central region.

Figure 4:
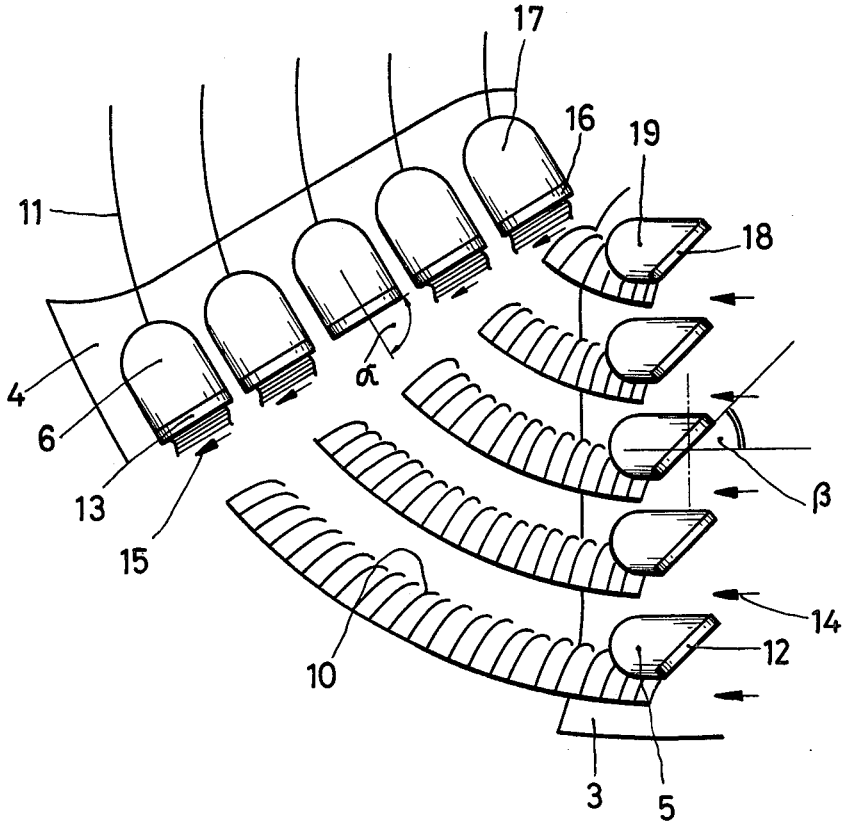
FIG. 4 shows a plan view, transferred into the plane, of a group of cutting elements with straight set cutting faces and a further group of cutting elements with obliquely set cutting faces set towards the marginal region.

The cooperation of the straight set and obliquely set cutting elements is illustrated in FIG. 4 which shows a plan view, transferred into the plane, of a cooperating pair of cutting edges. This consists of the cutting edge 3 carrying the cutting elements with obliquely set cutting faces 12 and the cutting edge 4 carrying cutting elements 6 with straight set cutting faces 13.

The reference numerals 18 and 19 distinguish the cutting plates set obliquely at the angle $\beta$ and the bevelled supporting members, while the reference numerals 16 and 17 designate the cutting plates disposed at the angle $\alpha$ to the cutting direction and so set straight and their supporting members. The cutting faces of the obliquely set cutting elements are designated by 12, while the cutting faces of the straight set cutting elements are designated by 13. The cutting lines 10 and 11, which distinguish the position of the deepest penetration of the cutting elements in the formation, show that the cutting elements are staggered. The flushing flow impressed by the nozzles, not shown, is illustrated by arrows 14 and 15. The flushing stream runs at first in the opposite direction to the direction of rotation of the bit through the gaps in the obliquely set cutting elements 5 and changes its direction to the outside along the straight set cutting elements 6. The drillings pared off are indicated in the drawing along the path described from the cutting elements. Whereas the formation is only broken up by the obliquely set cutting elements, the further paring off is effected by the straight set cutting elements.

Figure 5:
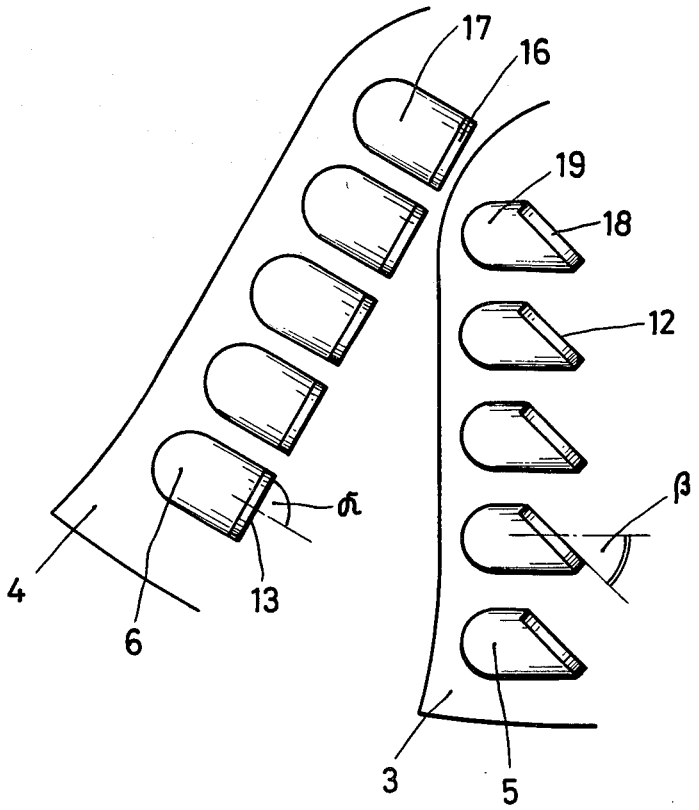
FIG. 5 shows a plan view, transferred into the plane, of a group of cutting elements with straight set cutting faces and a further group of cutting elements with cutting faces obliquely set towards the central region.

The arrangement of FIG. 5 differs from that of FIG. 4 by the different orientation of the cutting plates 18 of the obliquely set cutting elements 5. The cutting faces face towards the central region of the head. As distinct from FIG. 4, the angle between the cutting faces 12 and the cutting direction is designated by $\beta'$, but as regards amount has the same value as $\beta$.

Figure 6:
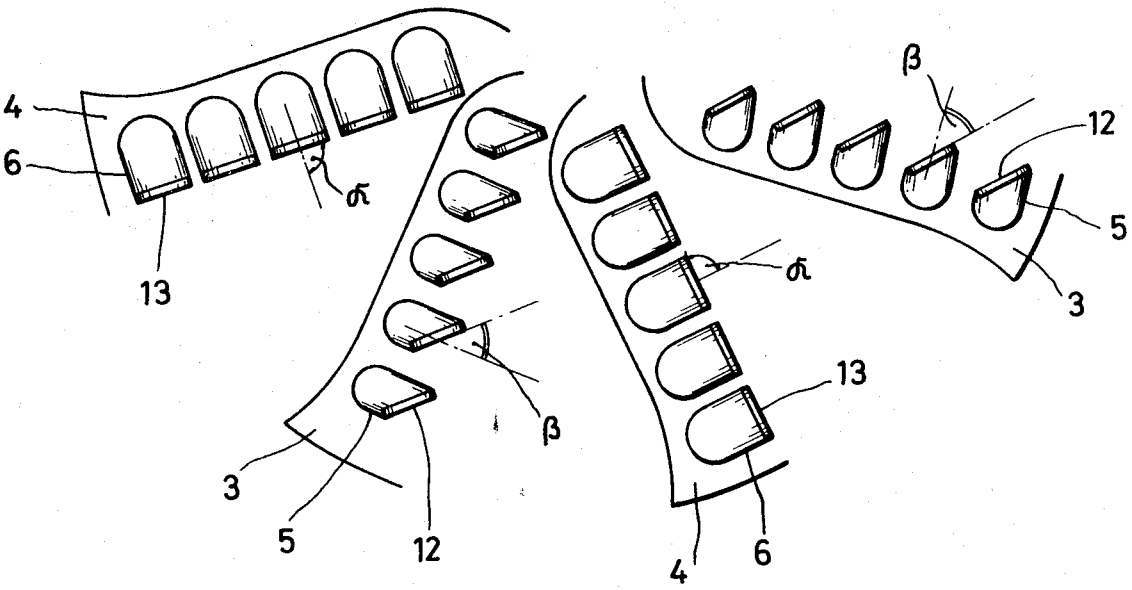
FIG. 6 shows a combination of the configurations illustrated in FIGS. 4 and 5.

A combination of the two embodiments in FIGS. 4, 5 is illustrated in FIG. 6. In the case of the obliquely set cutting elements 5, the orientation of their cutting faces alternates from one cutting edge to the next. As a result, the penetration behaviour of a bit thus equipped in the formation is neutral.

In the further figures, the illustration of the obliquely set cutting elements is restricted to the version with the cutting faces facing towards the marginal region of the head; it is also possible, however, in the following examples, to realize the other alternative or a combination of both.

Figure 7:
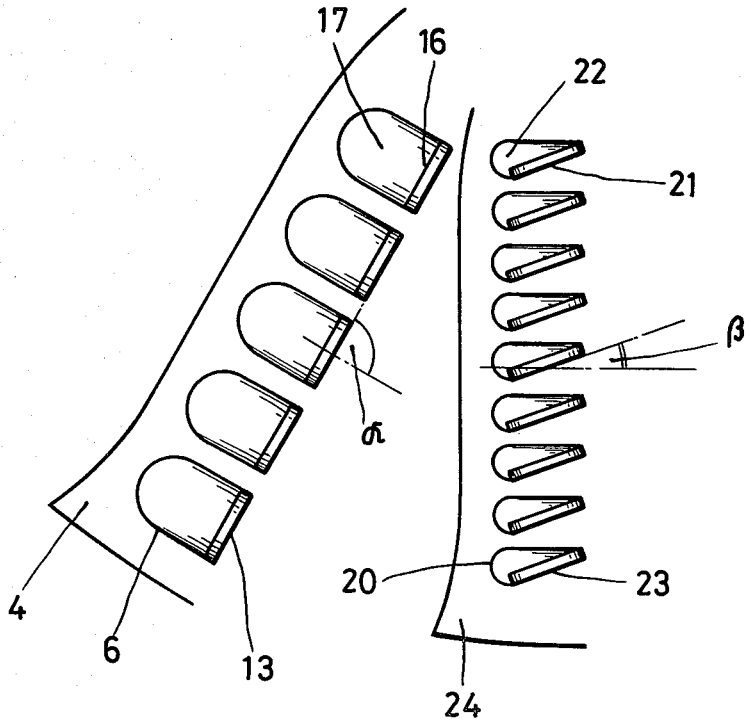
FIG. 7 shows a plan view, transferred into the plane, of a group of cutting elements with straight set cutting faces and a group of cutting elements with obliquely set cutting faces, two cutting elements with obliquely set cutting faces being allocated to the cutting width of each of the cutting elements with straight set faces.

FIG. 7 shows obliquely set cutting elements 20 which are set on a cutting edge 24 at a very acute angle to the cutting direction. As distinct from FIG. 4, here the reference numerals 21 are used for the cutting plates, 22 for the supporting members and 23 for the cutting faces. This embodiment is particularly advantageous when a shaft has to be sunk through very plastic material and an adequate pressure per unit area cannot be exerted on the formation by cutting elements set less obliquely—for example 5 from FIG. 4. Because of the smaller cutting width of the individual cutting elements, here a larger number is aligned side by side so that the following cutting elements 6 again find a sufficiently wide prepared surface in front of them for the removal with a cutting action. If it is difficult to arrange the obliquely set cutting elements side by side for reasons of space, they may also be staggered in arc measure.

Figure 8:
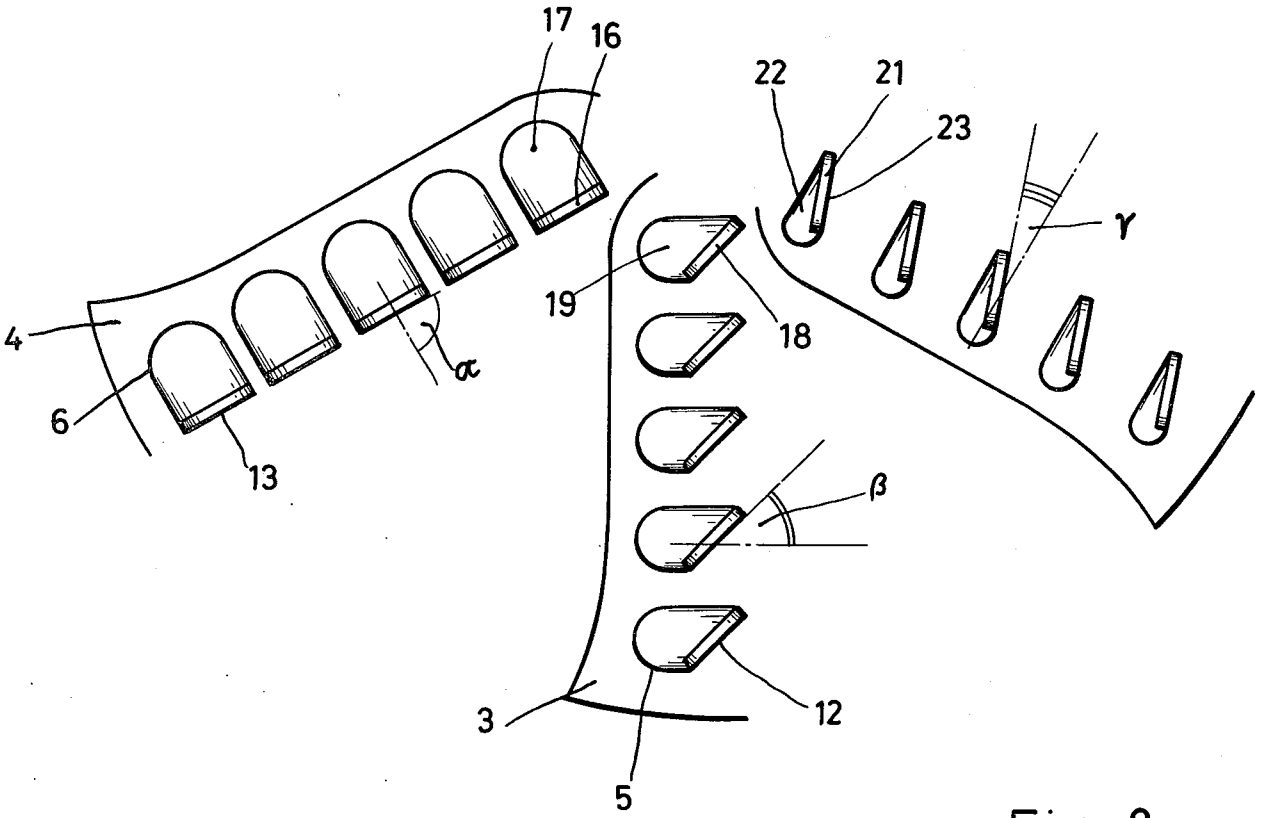
FIG. 8 shows a plan view, transferred into the plane, of a group of cutting elements with straight set cutting faces, a group of cutting elements with obliquely set cutting faces at an angle of about 45 degrees and a further group of cutting elements with cutting faces set very obliquely at an angle of about 20 degrees.

In FIG. 8—in which cutting elements 20 with cutting faces 23 set at a very acute angle are likewise used—the necessary width of the cutting region for the cutting elements 6 with a straight cutting face is achieved as a result of the fact that the cutting width left behind by the cutting elements 20 is widened by cutting elements 5 with cutting faces 12 set less obliquely.

Figure 9:
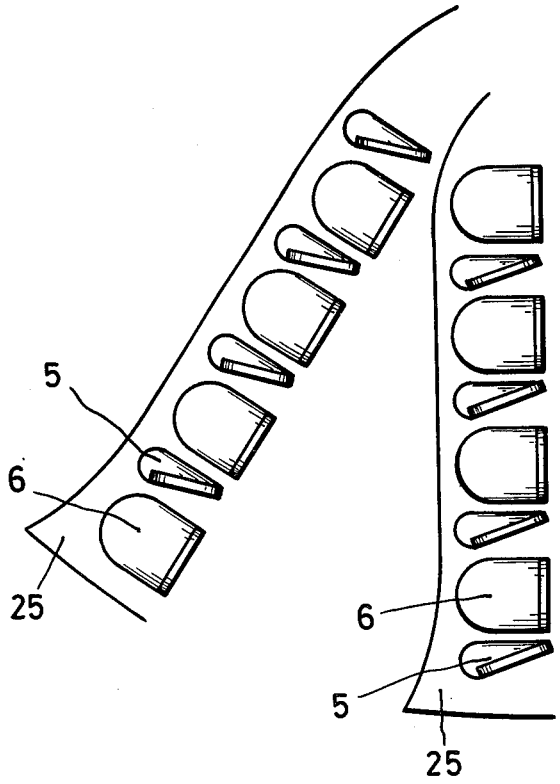
FIGS. 9–15 show further arrangements of cutting elements.
Figure 10:
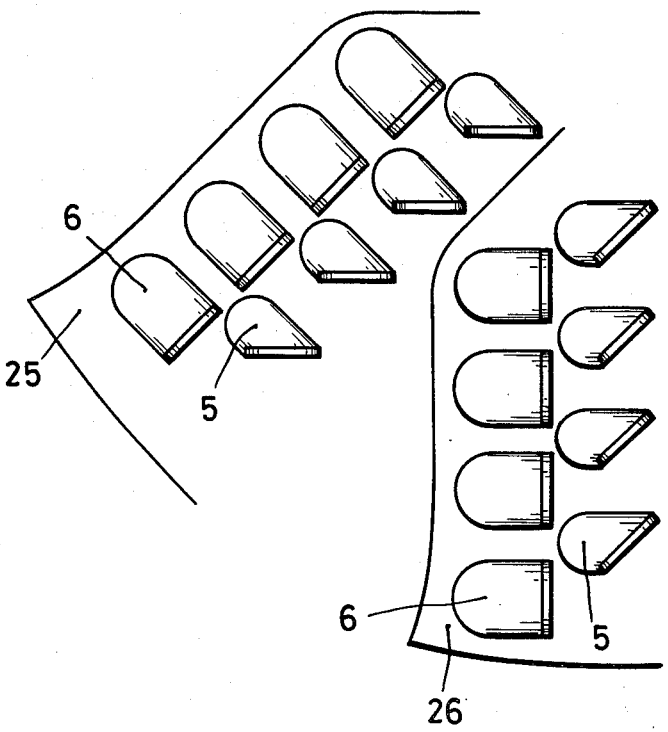
Figure 11:
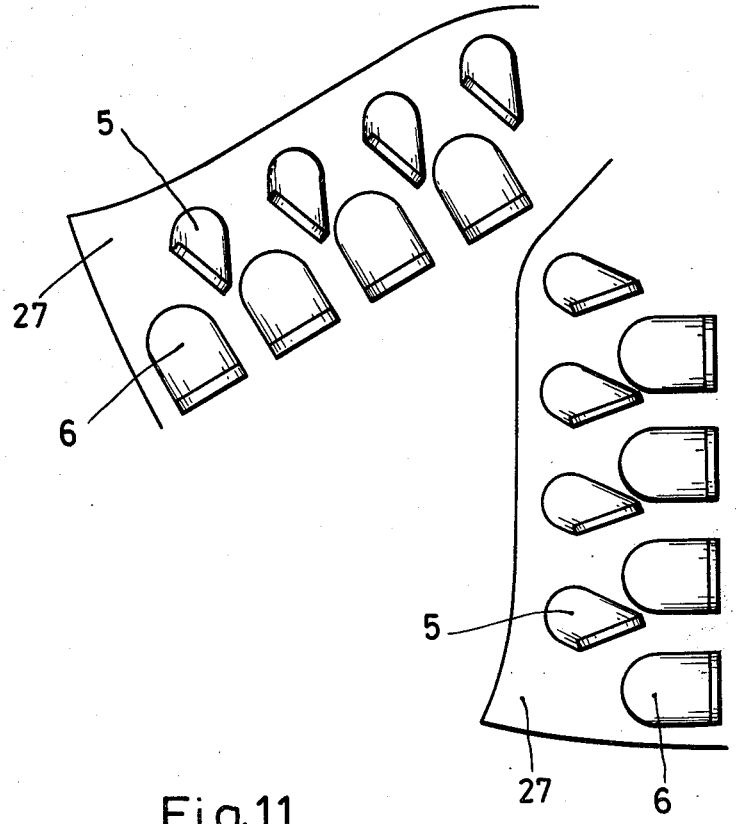

FIGS. 9, 10, 11 show a combined arrangement of the different cutting elements 5, 6 on each cutting edge 25, 26, 27. With the arrangement of the cutting elements in FIGS. 9 and 11, the formation is torn up by the cutting elements 5 with obliquely set cutting faces and pared off by the cutting elements with a straight cutting face disposed on the cutting edge situated behind in the direction of rotation.

In the version shown in FIG. 10, the tearing up and paring off of the formation is effected by the same cutting edge 26 because this already comprises the two kinds of cutting elements in the arrangement corresponding to the working sequence, namely cutting elements 6 behind cutting elements 5.

Figure 12:
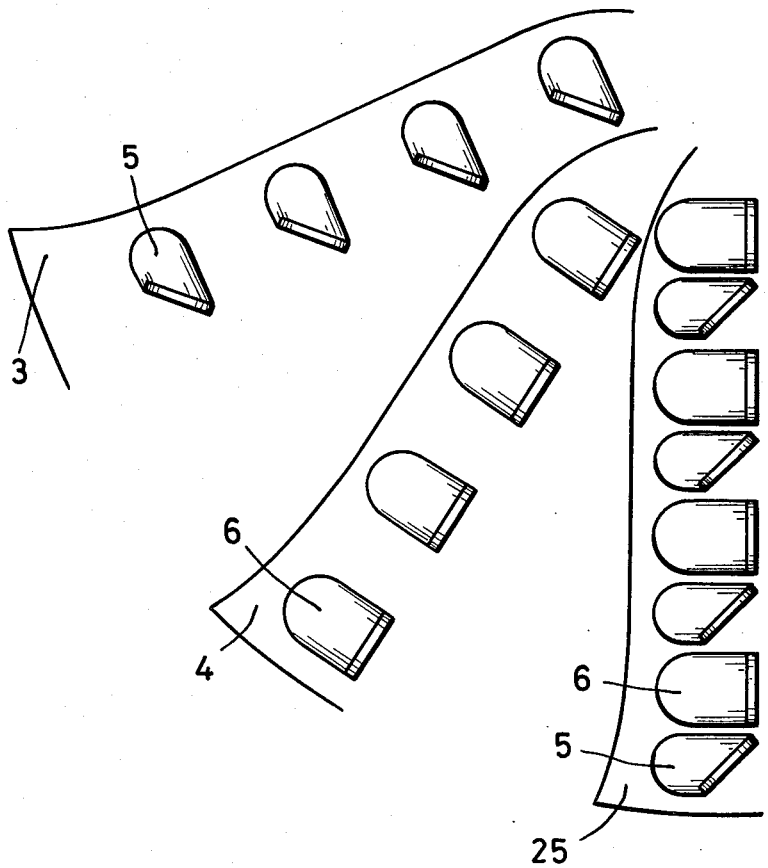
Figure 13:
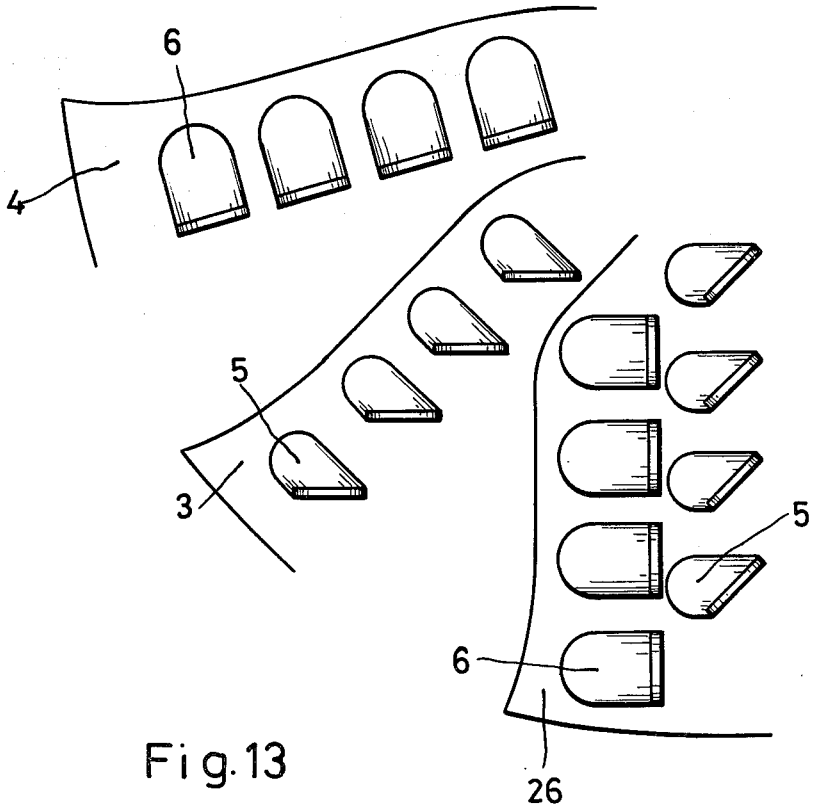
Figure 14:
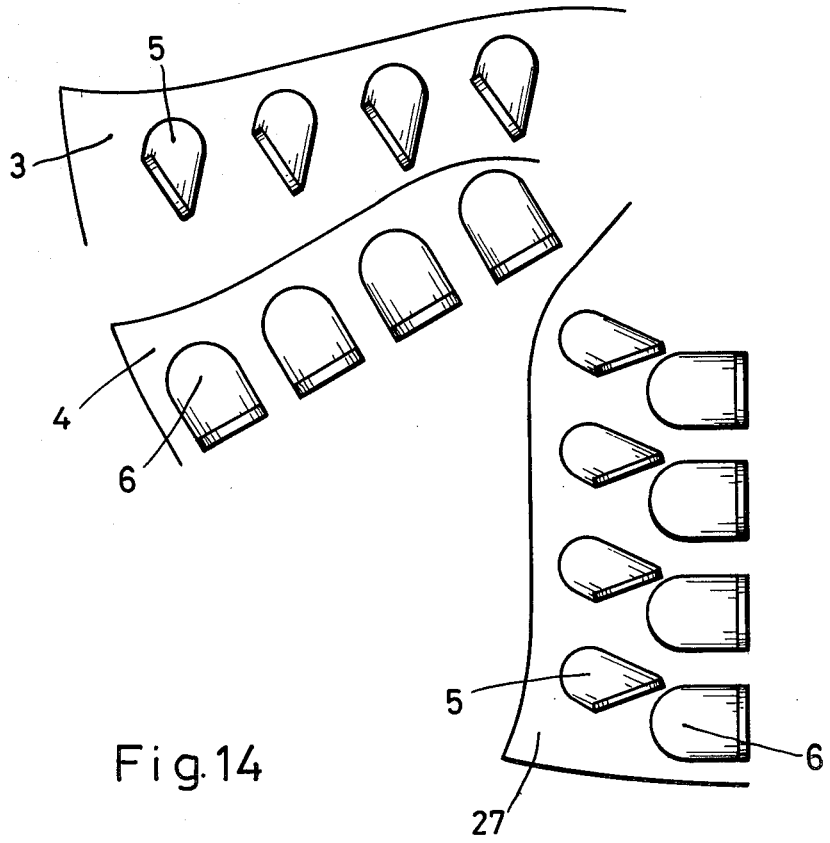

FIGS. 12, 13, 14 show arrangements which consist of a combination of the cutting edges 25, 26, 27, as illustrated in FIGS. 9, 10, 11, with the cutting edges 3 and 4 from FIG. 4. Thus the cooperation of the straight set and obliquely set cutting elements 5, 6 is also possible when the cutting elements are disposed partially together, partially separately on the cutting edges.

Figure 15:
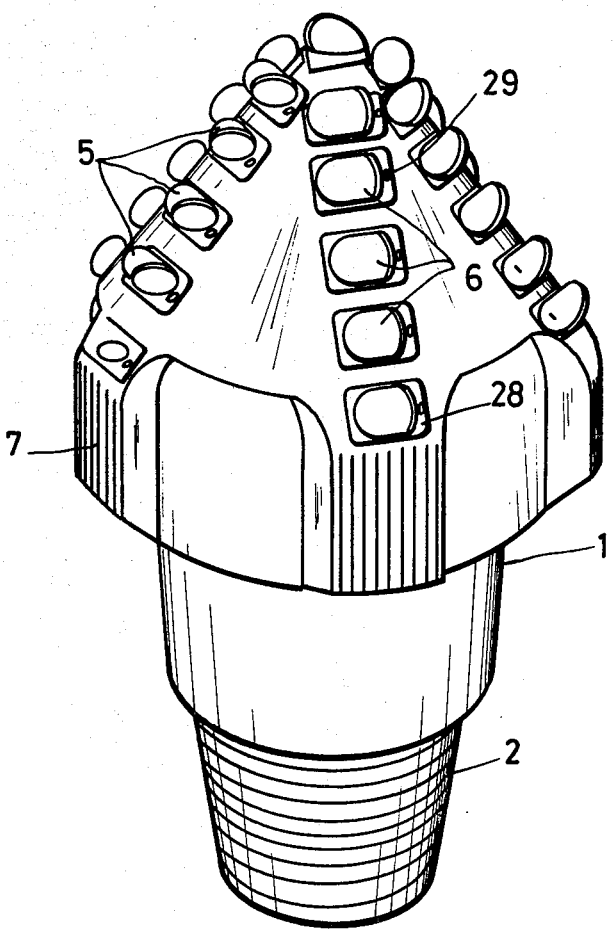

In the rotary drill bit illustrated in FIG. 15, in contrast to FIG. 1, the cutting elements 5, 6 are disposed distributed over the surface of the bit. In this case, the cutting elements are constructed in the form of modules 28 and are each provided with outlets 29 for the flushing liquid associated with the cutting faces. As used in the appended claims, the term "horizontal" refers to any plane perpendicular to the axis of rotation of the drill bit.

The embodiments of the invention in which an exclusive property or privilege is claimed are defined as follows:

1. A rotary drill bit comprising a threaded pin for a connection to a drilling string or the like rotary drive, and a head provided with groups of cutting elements, each of which comprises a plane cutting face, consisting of a polycrystalline sintered diamond layer secured to a supporting member, which groups extend radially from the marginal region of the head into its central region, and in which at least two groups of cutting elements differ with regard to the setting angle of the cutting faces to the direction of cut such that a horizontal line lying in the cutting faces of straight set cutting elements in one group lies substantially at right angles to the direction of cut while a horizontal line lying in the cutting faces of obliquely set cutting elements in the other group lies at an acute angle to the direction of cut, so as to face outward of the bit.

2. A rotary drill bit as claimed in claim 1, in which the obliquely set cutting elements are disposed in relation to the straight set cutting elements so that their cutting regions at least partially overlap.

3. A rotary drill bit as claimed in claim 2, in which a plurality of obliquely set cutting elements are disposed within the particular cutting ranges of the straight set cutting elements.

4. A rotary drill bit as claimed in claim 3, in which each cutting edge comprises straight set and obliquely set cutting elements.

5. A rotary drill bit as claimed in claim 4, in which straight set cutting elements and obliquely set cutting elements, which are graduated radially alternately are disposed on each cutting edge from the marginal region to the central region of the bit head.

6. A rotary drill bit as claimed in claim 5, in which both kinds of cutting element are disposed side by side.

7. A rotary drill bit as claimed in claim 5, in which the obliquely set cutting elements are circumferentially offset relative to the straight set cutting elements.

8. A rotary drill bit as claimed in claim 1, in which the cutting elements are staggered with regard to their setting angle of the cutting faces to the cutting direction and the cutting regions of the cutting elements with a very small setting angle lie within the cutting regions of following cutting elements with a larger setting angle.

9. A rotary drill bit as claimed in claim 8, in which the cutting elements are combined in groups in the form of rows or strips, as cutting edges.

10. A rotary drill bit as claimed in claim 9, in which alternately, one cutting edge comprises straight set cutting elements and an adjacent cutting edge comprises obliquely set cutting elements.

11. A rotary drill bit as claimed in claim 10, in which the straight set cutting elements are disposed staggered in relation to the cutting lines of the obliquely set cutting elements with regard to the cutting lines described thereby.

12. A rotary drill bit as claimed in claim 10, in which nozzles for flushing liquid are disposed in front of the cutting edges in the direction of rotation of the bit, which nozzles communicate with a central bore in the interior of the bit, the outlet mouths of the nozzles allocated to the obliquely set cutting elements being so directed and composed that a substantially tangential directional component in the direction of rotation counter to the bit is impressed on the flushing jet, and the outlet mouths of the nozzles allocated to the straight set cutting elements being so directed and composed that a substantially radial outwardly directed component is impressed on the flushing jet.

13. A rotary drill bit as claimed in claim 1, in which the cutting elements are disposed staggered radially in relation to similar cutting elements on adjacent cutting edges with regard to their orientation.

* * * * *